US006122923A

United States Patent [19]

Sullivan

[11] Patent Number: 6,122,923

[45] Date of Patent: Sep. 26, 2000

[54] CHARGE CONTROL FOR A FRESH AIR REFRIGERATION SYSTEM

[75] Inventor: Brian T. Sullivan, La Crosse, Wis.

[73] Assignee: American Standard Inc., Piscataway, N.J.

[21] Appl. No.: 09/249,411

[22] Filed: Feb. 12, 1999

[51] Int. Cl.[7] ..... F25B 41/00

[52] U.S. Cl. ..... 62/174; 62/173; 62/324.4; 62/509

[58] Field of Search ..... 62/174, 509, 324.4, 62/173, 149

[56] References Cited

U.S. PATENT DOCUMENTS

| | | | |
|---|---|---|---|
| 3,064,445 | 11/1962 | Gerteis | 62/174 |
| 4,484,452 | 11/1984 | Houser, Jr. | 62/174 |
| 4,562,700 | 1/1986 | Atsumi et al. | 62/174 |
| 4,621,505 | 11/1986 | Ares et al. | 62/509 |
| 4,655,051 | 4/1987 | Jones | 62/324.4 |
| 4,722,195 | 2/1988 | Suzuki et al. | 62/149 |
| 5,070,705 | 12/1991 | Goodson et al. | 62/197 |
| 5,115,644 | 5/1992 | Alsenz | 62/181 |
| 5,163,304 | 11/1992 | Phillippe | 62/509 |
| 5,372,013 | 12/1994 | Lau et al. | 62/174 |
| 5,937,660 | 8/1999 | Lau et al. | 62/174 |

OTHER PUBLICATIONS

1990 Ashrae Handbook for Refrigeration Systems and Applications, p. 3.13.

1990 Ashrae Handbook for Refrigeration Systems and Applications, p. 3.23.

*Primary Examiner*—William Doerrler

*Assistant Examiner*—Marc Norman

*Attorney, Agent, or Firm*—William J. Beres; William O'Driscoll; Peter D. Ferguson

[57] ABSTRACT

A refrigeration system comprising: a duct; a compressor having an inlet and an outlet; a reheat coil located in the duct and having an outlet and an inlet operatively connected to the compressor outlet; and a condenser having an outlet, and an inlet operatively connected to the reheat coil outlet. The system also comprises an expansion device, an evaporator and a receiver system. The expansion device has an outlet, and an inlet operatively connected to the condenser outlet. The evaporator is located in the duct upstream of the reheat coil and has an inlet operatively connected to the expansion device outlet, and has an outlet operatively connected to the compressor inlet. The receiver system has an inlet operatively connected to the condenser outlet and has an outlet operatively connected to the evaporator inlet. The receiver system includes an upstream flow control device, a receiver and a downstream flow control device in series.

41 Claims, 2 Drawing Sheets

CHARGE CONTROL FOR A FRESH AIR REFRIGERATION SYSTEM

BACKGROUND OF THE INVENTION

The present invention focuses on charge control in an outdoor air treatment and ventilation system delivering properly conditioned outdoor air in HVAC systems. The primary benefit of using this type of system is the ability to properly heat, cool and/or dehumidify outdoor ventilation air independently of the other equipment in the system.

A problem occurs during the operation of a fresh air refrigeration unit having series connected condensers when a large part of the heat rejection of the refrigerant system takes place in the reheat coil. As more and more air is directed over the reheat coil, refrigerant temperature drops and refrigerant condenses. The cooler than normal refrigerant enters an outdoor condenser coil to be cooled even further. Since there is insufficient charge to support this operation, the condensation of refrigerant in the outdoor coil begins to starve the thermal expansion valve in the refrigeration system. In order to maximize the capacity of the reheat coil, the heat rejection in the outdoor condenser coil needs to be minimized and sufficient charge must be made available to the thermal expansion valve.

SUMMARY OF THE INVENTION

It is an object, feature and advantage of the present invention to solve the problems of the prior art systems. More specifically, the present invention optimizes the charge control system for a fresh air unit.

It is an object, feature and advantage of the present invention to modulate the capacity of a reheat coil by controlling the amount of liquid refrigerant in a condenser's coil. It is a further object, feature and advantage of the present invention to control the amount of airflow over the reheat coil. It is another object, feature and advantage of the present invention to ensure that sufficient charge is made available at the expansion valve.

It is an object, feature and advantage of the present invention to provide a receiver in parallel with an expansion valve. It is a further object, feature and advantage of the present invention to modulate the transfer of refrigerant charge in the system between the receiver and the outdoor condenser coil. It is another object, feature and advantage of the present invention to allow liquid refrigerant to partially fill the outdoor condenser coil.

It is an object, feature and advantage of the present invention to increase the heat rejection capacity of the outdoor condenser coil by causing the receiver to fill with refrigerant and expose condensing surface in the outdoor condensing coil.

It is an object, feature and advantage of the present invention to decrease the heat rejection capacity of the outdoor condenser coil by causing the receiver to drain refrigerant and to cover condensing surface in the outdoor condensing coil.

The present invention provides a refrigeration system. The system includes an expansion device and a condenser connected in series arrangement with the expansion device. The system also includes a receiver connected in parallel arrangement with the expansion device and in series arrangement with the condenser. The system may also comprise isolation connections for the receiver upstream and downstream of the receiver; a condition sensor sensing a condition of an air conditioning system; and a controller operably connected to the isolation connections and to the condition sensor.

The present invention also provides a method of controlling charge in an air conditioning system having a high pressure side and a low pressure side. The method comprises the steps of: locating a receiver in parallel with an expansion device; placing flow control devices both upstream and downstream of the receiver; opening the upstream flow control valve to transfer charge from the high pressure side to the receiver; and opening the downstream flow control device to transfer charge from the receiver thru the low pressure side to the condenser coil.

The present invention further provides a method of controlling charge in a refrigeration system. The method comprises the steps of: arranging a receiver and valving arrangement in parallel with an expansion device; arranging both the receiver and the valving arrangement in series between a condenser and an evaporator; controlling the receiver valving as a function of a condenser condition; and controlling the expansion device as a function of an evaporator condition.

The present invention still further provides a method of controlling charge in a refrigeration system including a condenser and a receiver. The method comprises the steps of: monitoring the subcooling temperature of the condenser; draining refrigerant from the receiver into the condenser if the subcooling temperature is less than a desired amount; and filling the receiver with refrigerant if the subcooling temperature is greater than a desired amount.

The present invention yet further provides a refrigeration system. The system comprises a duct; a compressor having an inlet and an outlet; a reheat coil located in the duct and having an outlet and an inlet operatively connected to the compressor outlet. The system also comprises a condenser having an outlet, and an inlet operatively connected to the reheat coil outlet; an expansion device having an outlet, and an inlet operatively connected to the condenser outlet; and an evaporator located in the duct upstream of the reheat coil and having an inlet operatively connected to the expansion device outlet, and having an outlet operatively connected to the compressor inlet. The system further comprises a receiver system having an inlet operatively connected to the condenser outlet and having an outlet operatively connected to the evaporator inlet. The receiver system includes an upstream flow control device, a receiver and a downstream flow control device arranged in series.

The present invention also provides a refrigeration system having a high pressure side and a low pressure side. The system comprises: an expansion device located between the high pressure side and the low pressure side; a condenser in the high pressure side having refrigerant connections; and a receiver having refrigerant connections connected between the high pressure side and the low pressure side.

DETAILED DESCRIPTION OF THE DRAWING

Figure 1:
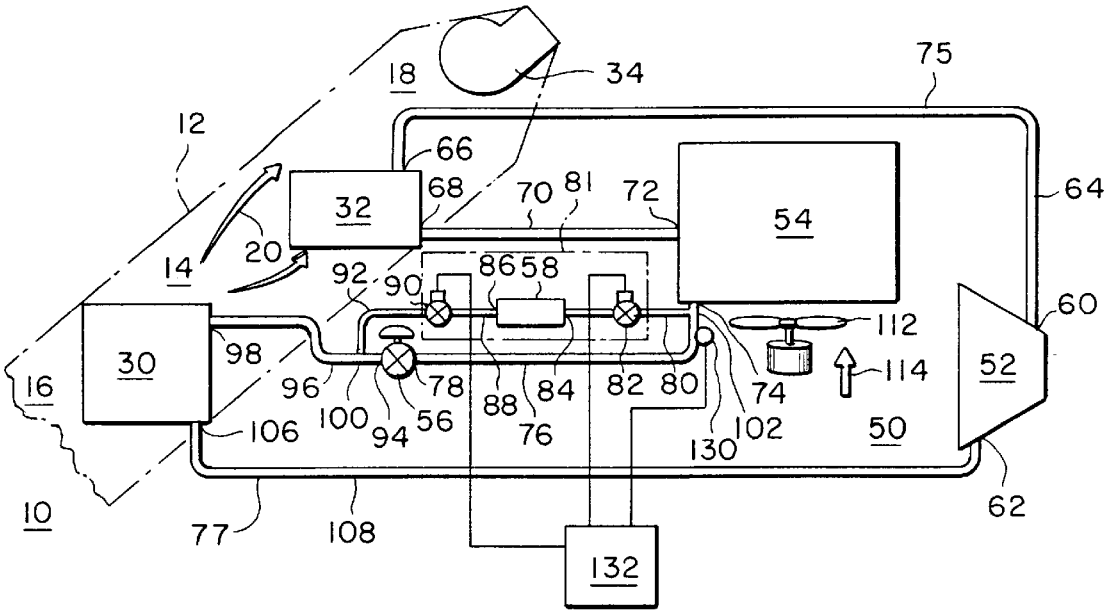
FIG. 1 is a diagram of a fresh air unit in accordance with the present invention.

FIG. 1 shows a fresh air unit 10 which is also referred to as an outdoor air conditioning unit or as an air conditioning unit throughout this application. The fresh air unit 10 can be implemented as a water source heat pump, a vertical or horizontal fan coil, the constant volume direct expansion rooftop unit, the constant volume direct expansion split system, a blower coil, a packaged terminal air conditioner, or the like. Suitable systems are sold by The Trane Company, a Division of American Standard Inc., under the trademark CommandAir™, UniTrane™, Voyager™ and Odyssey™. Additionally, various air handlers such as those sold by The Trane Company under the trademark Modular Climate Changer™ and Climate Changers™ are also suitable.

The fresh air unit 10 includes a housing 12 arranged about an air path 14. The air path 14 has an outdoor air inlet 16 connected to a source of outdoor air, and has a building outlet 18 connected to a space or spaces to be conditioned. The air path 14 provides supply air to the space or spaces requiring a fresh air supply. To accomplish this, an airstream 20 flows through the housing 12 and along the airflow path 14 from the inlet 16 to the outlet 18.

In its preferred embodiment, the fresh air unit 10 includes an evaporator 30 located in the airflow path 14 and a reheat coil 32 also located in the airflow path 14 but downstream of the evaporator 30. A blower 34 is located in the airflow path 14 at any convenient location to motivate the airflow 20 through the housing 12. In the preferred embodiment the blower 34 is located proximal the outlet 18 but could just as well be located near the inlet 16 or between the evaporator 30 and the reheat coil 32.

The evaporator 30 and the reheat coil 32 are part of a refrigeration circuit 50 which also includes a compressor 52, an outdoor condenser coil 54, an expansion device 56 such as a thermal expansion valve, capillary tube, or electronic expansion valve, and a receiver 58. The compressor 52 has an outlet 60 and an inlet 62. The compressor outlet 60 is linked by conduit 64 to an inlet 66 of the reheat coil 32. An outlet 68 of the reheat coil 32 is linked by conduit 70 to an inlet 72 of the outdoor condenser coil 54. The outdoor condenser coil 54 has an outlet 74 linked by conduit 76 to an inlet 78 of the expansion valve 56. The outlet 74 of the outdoor condenser coil 54 is also linked by conduit 80 to a receiver system 81 including the receiver 58. A high pressure side 75 of the refrigeration circuit 50 lies between the compressor 52 and the expansion device 56, the high pressure side 75 including the outdoor condenser coil 54 and the reheat coil 32. A low pressure side 77 of the refrigeration circuit 50 lies between the expansion device 56 and the compressor 52, the low pressure side 77 including the evaporator 30.

The receiver system 81 includes an upstream flow control device 82 such as a solenoid valve, a capillary tube or other flow restricting device, the receiver 58, and a downstream flow control device 90 such as a solenoid valve or a capillary tube, or other flow restricting device. The upstream control valve 82 receives refrigerant from the high pressure side 75 of the refrigeration circuit 50 and controls flow through the conduit 80 to an inlet 84 of the receiver 58. The receiver 58 has an outlet 86 linked by conduit 88 to the control valve 90. The downstream control valve 90 controls fluid flow through the conduit 88 from the receiver 58 to the low pressure side 77 of the refrigeration circuit 50. Flow from the control valve 90 exits into conduit 92.

The expansion device 56 has an outlet 94 connected to conduit 96 leading to an inlet 98 of the evaporator 30. The conduit 92 from the control device 90 is connected to the conduit 96 downstream of the outlet 94 at a point 100 which is preferably at any location in the conduit 96 including at the inlet 98 but may be also located at any point in the low pressure side 77 of the refrigeration circuit 50. The conduit 80 is preferably connected to the conduit 76 upstream of the expansion device 56 at a point 102 but may be connected at any point in the high pressure side 75 of the refrigeration circuit 50. The receiver system 81 is basically in a parallel circuiting arrangement with the expansion device 56, and the combined parallel arrangement of the receiver system 81 and the expansion device 56 are in series with the outdoor condenser coil 54 and the evaporator 30. The evaporator 30 has an outlet 106 connected by conduit 108 to the compressor inlet 62.

Figure 2:
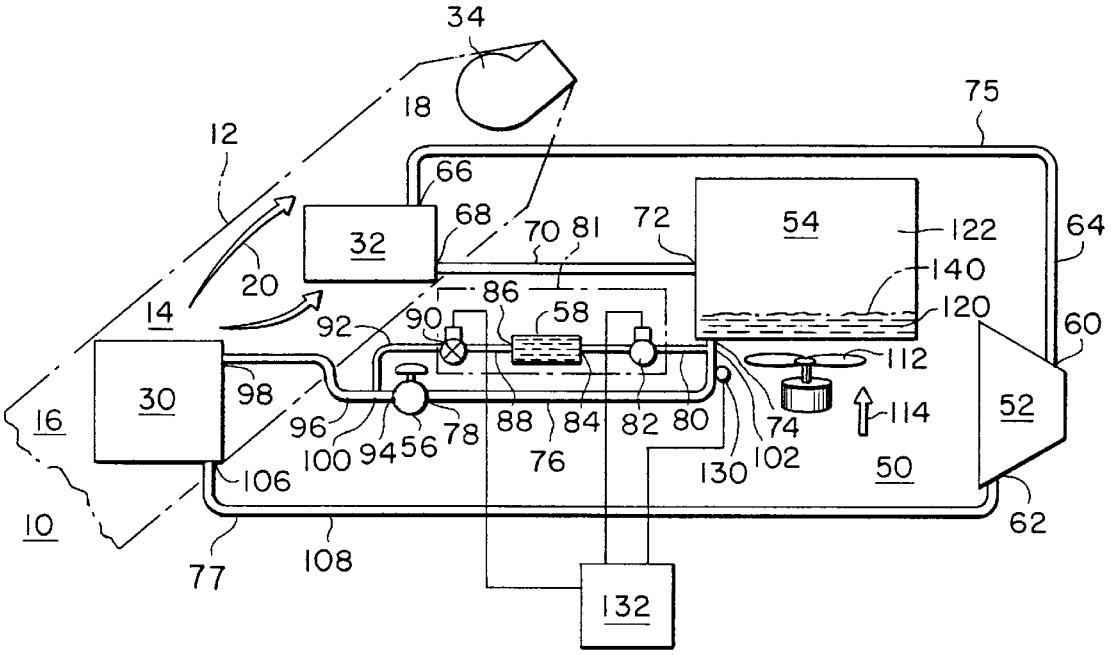
FIG. 2 is a diagram of the fresh air unit of FIG. 1 showing increased heat rejection capacity of the outdoor condensing coil.
Figure 3:
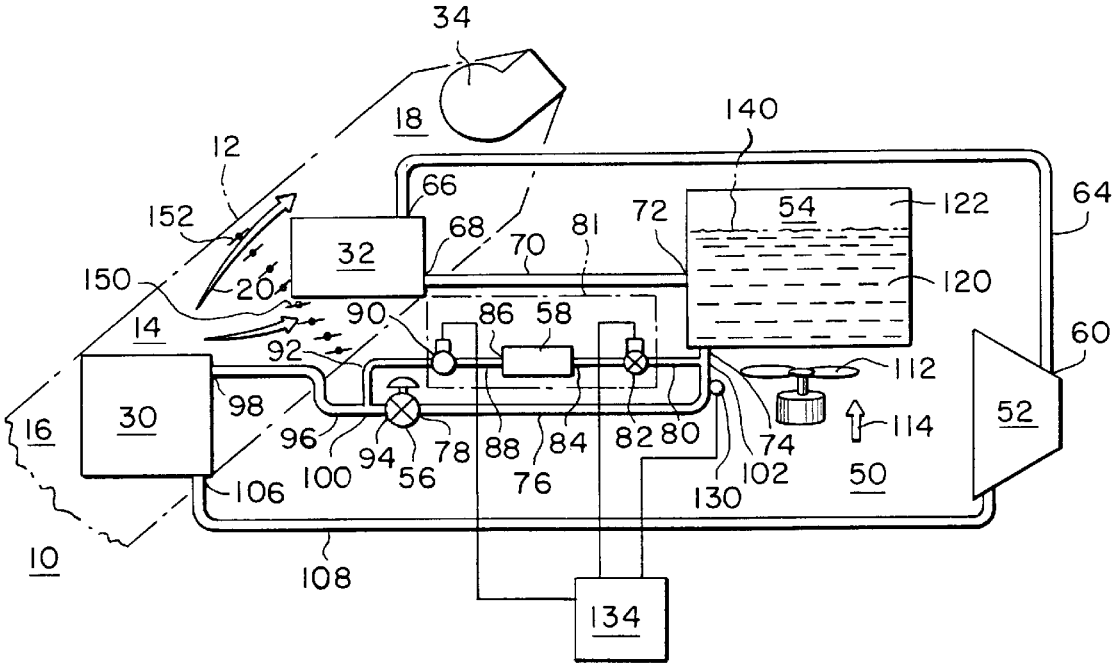
FIG. 3 is a diagram of the fresh air unit of FIG. 1 showing reduced heat rejection capacity of the outdoor condenser coil.

The outdoor condenser coil 54 is preferably an air cooled condenser cooled by an air mover 112 such as an axial fan. The air mover 112 moves air 114 across the face of the outdoor condenser coil 54. A characteristic of the outdoor condenser coil is that a nonflooded portion 122 of the outdoor condenser coil 54 exchanges heat at least an order of magnitude better than a flooded portion 120 of the outdoor condenser coil 54. FIGS. 2 and 3 illustrates the flooded portion 120 and the nonflooded portion 122 of the outdoor condenser coil 54 at various charge levels.

The receiver 58 is exposed to an air temperature that is intermediate to the saturated discharge and saturated suction temperatures at the compressor 52. When the valve 82 is opened and the control valve 90 is closed, charge is removed from the system 50 as liquid refrigerant leaves the outdoor condenser coil 54 through the outlet 74 and passes along conduit 80 through the open control valve 82 into the receiver 58. As a charge of liquid refrigerant accumulates in the receiver 58, more condensing surface in the non-flooded portion 122 of the outdoor condenser coil 54 is exposed.

The receiver 58 is sized to partially or fully fill the outdoor coil 54 with liquid refrigerant when the receiver 58 is completely drained. The receiver 58 may be sized to have about the same capacity as the outdoor coil 54.

The flooding of the outdoor condenser coil 54 is controllably modulated by opening and closing the control valves 82, 90. A sensor 130 (or a combination of sensors) is operably connected to a controller 132 which is also operably connected to the control valves 82 and 90. The sensor 130 determines subcooling by measuring and comparing refrigerant saturation temperature and the temperature of refrigerant entering the expansion device 56. Condenser subcooling is monitored by the sensor 130 and, as described below, the controller 132 opens or closes the control valves 82, 90 to remove or add charge to the outdoor condenser 54, and thereby control the heat rejection in the reheat coil 34.

When it is desirable to add charge to the system, the control valve 90 is opened and the control valve 82 is closed. Refrigerant moves from the receiver 58 into the conduit 96, enters the evaporator 30 (or vapor can bypass the evaporator directly to compressor suction 103 such as indicated by line 134 in FIG. 2), and eventually reaches the outdoor condenser coil 54 where it is backed up by the combination of the closed control valve 82 and the metering action of the expansion device 56. As illustrated by FIG. 3, when the receiver 58 is completely drained, the outdoor condenser coil 54 will be partially or completely filled, depending on the receiver 58 sizing relative to the condensing coil 54. As the receiver 58 moves charge to or from the coil 54, a zone of phase change 140 demarking the flooded portion 120 and the non-flooded portion 122 will also change. If the condensing coil is partially filled, the phase change area 140 divides the outdoor condenser coil 54 into the flooded portion 120 where heat rejection is almost nonexistent, and a nonflooded portion 122 where heat rejection occurs. By shutting off the air mover 112, the heat rejection in the nonflooded portion 122 can be further limited. In such a situation, the only significant heat rejection occurs in the reheat coil 32 thus maximizing the capacity of that coil 32. At the same time, the heat rejection of the outdoor condenser coil 54 is minimized while ensuring, with the accumulated refrigerant in the flooded portion 120, that sufficient charge is always available to the expansion device 56.

When more heat rejection capacity is required in the outdoor condenser coil 54, the valve 90 is closed and the control valve 82 is opened. This allows the receiver 58 to fill with refrigerant thereby exposing more condensing surface in the outdoor condensing coil 54. This is illustrated in FIG. 2 where the zone 140 is much lower than the corresponding zone 140 shown in FIG. 3 and where the nonflooded portion 122 is much larger than the flooded portion 120.

By using the controller 132 to modulate the amount of charge in the receiver 56 based upon the desired subcooling of the outdoor condenser coil 54, the system 10 can be made to run smoothly while ensuring that a desired amount of reheat is available from the reheat coil 32. If it is desirable that the receiver 58 be drained quickly, it is preferable to drain liquid through the line 92 to the evaporator 30. If it is more desirable to drain the receiver 58 slowly, vapor can be pulled off from an upper area (not shown) of the receiver 58 and directed either by the lines 92 and 96 to the evaporator 30 or alternatively directly to compressor suction 108 as indicated by line 134 of FIG. 3.

Airflow over the reheat coil 32 may also be controlled using face and bypass dampers 150, 152. The face dampers 150 can be fully opened to allow complete airflow over the reheat coil 32 while the bypass dampers 152 are closed. Conversely the face dampers 150 can be modulated completely closed while the bypass dampers 152 are completely open to thereby reduce the airflow over the reheat coil 32 to virtually no airflow.

Completely filling the outdoor coil 54 directs all heat rejection to the reheat coil 32. Completely filling the receiver 58, and closing the face dampers 150, directs all heat rejection to the outdoor coil 54. It is possible to modulate anywhere therebetween by monitoring the subcooling sensor 130 and opening the valves 82, 90 as well as controlling the face and bypass dampers 150, 152 and the fan speed 112.

The foregoing invention has been described in terms of a fresh air unit which controls the charge while providing the appropriate amount of reheat. It will be apparent to a person of ordinary skill in the art that many alterations and modifications of this system are apparent. Such modification and alteration including the substitution of various criteria other than condenser subcooling as the criteria for charge control. Additionally, the application of the equipment will vary so as to include air handling in a commercial sense through the gamut of products to air handling in a residential sense. All such modifications and alterations are intended to be encompassed by the claimed invention.

What is desired to be secured for Letters Patent of the United States is set forth in the following claims.

What is claimed is:

1. A fresh air refrigeration system comprising:

an air path having an inlet connected to a source of outside air and an outlet connected to a space to be conditioned;

an expansion device;

a condenser having refrigerant connections;

a reheat coil located in the air path and having refrigerant connections in series arrangement with the condenser; and a receiver having refrigerant connections connected in parallel arrangement with the expansion device and in series arrangement with the condenser.

2. The system of claim 1 wherein the receiver refrigerant connections further include:

upstream and downstream isolation connections for the receiver wherein the upstream isolation connection is to a high side of a refrigeration system including the expansion device and the condenser and wherein the downstream isolation connection is to a low pressure side of the refrigeration system.

3. A fresh air refrigeration system comprising:

an expansion device;

a condenser having refrigerant connections;

a receiver having refrigerant connections connected in parallel arrangement with the expansion device and in series arrangement with the condenser, the receiver refrigerant connections further include upstream and downstream isolation connections for the receiver wherein the upstream isolation connection is to a high side of a refrigeration system including the expansion device and the condenser and wherein the downstream isolation connection is to a low pressure side of the refrigeration system;

a condition sensor sensing a condition of an air conditioning system; and a controller, operably connected to the isolation connections and to the condition sensor, and controlling the operation of the isolation connections.

4. The system of claim 3 further including:

an evaporator and a compressor connected in series with the expansion device and the condenser, the compressor being located between the high pressure side and the low pressure side, the evaporator being located in the low pressure side.

5. The system of claim 4 further including:

a reheat coil arranged in the high pressure side between the compressor and the condenser.

6. The system of claim 5 further including face and bypass dampers associated with the reheat coil and controlling airflow therethrough.

7. The system of claim 5 wherein the isolation connections are flow control devices.

8. The system of claim 7 wherein the condition sensor senses condenser subcooling.

9. The system of claim 8 further including a sensor operably associated with the evaporator and sensing refrigerant superheat.

10. The system of claim 9 wherein the controller controls the transfer of refrigerant between the receiver and the condenser responsive to the sensed subcooling.

11. The system of claim 10 wherein the receiver is sized to at least partially fill the condenser with refrigerant when the receiver is completely drained.

12. A fresh air refrigeration system comprising:

an expansion device;

a condenser having refrigerant connections; and a receiver having refrigerant connections connected in parallel arrangement with the expansion device and in series arrangement with the condenser;

wherein the receiver is sized to at least partially fill the condenser with refrigerant when the receiver is completely drained.

13. A method of controlling charge in an air conditioning system having a high pressure side and a low pressure side, comprising the steps of:

locating a receiver in parallel with an expansion device;

placing flow control devices both upstream and downstream of the receiver;

opening the upstream flow control device to transfer charge from the high pressure side to the receiver; and opening the downstream flow control device to transfer charge thru the low pressure side to a condenser coil.

14. The method of claim 13 including the further step of controlling outdoor coil capacity by flooding and unflooding the condenser.

15. The method of claim 14 including the further step of storing excess outdoor coil refrigerant in the receiver.

16. The method of claim 14 including the further step of controlling outdoor coil capacity by reducing or increasing airflow over the condenser coil.

17. The method of claim 13 including sizing the receiver to partially fill the outdoor condensing coil with refrigerant when the receiver is completely drained.

18. The method of claim 13 including the further steps of determining a measure of outdoor condensing coil subcooling, and controlling the opening steps responsive to that subcooling determination.

19. The method of claim 13 including the further step of placing both the receiver and the expansion device in series with the outdoor condenser coil.

20. A method of controlling charge in a refrigeration system comprising the steps of:

arranging a receiver and valving arrangement in parallel with an expansion device;

arranging both the receiver and the valving arrangement in series between a condenser and an evaporator;

controlling the receiver valving as a function of a condenser condition; and controlling the expansion device as a function of an evaporator condition.

21. The method of claim 20 wherein the condenser condition is condenser subcooling.

22. The method of claim 21 wherein the subcooling is determined by temperature measurements.

23. The method of claim 22 wherein the evaporator condition is refrigerant superheat temperature.

24. The method of claim 23 including the further step of sizing the receiver to partially fill the condenser with refrigerant when the receiver is completely drained of refrigerant.

25. The method of claim 23 including the further step of sizing the receiver to fully fill the condenser with refrigerant when the receiver is completely drained of refrigerant.

26. The method of claim 24 further including the steps of:

draining refrigerant from the receiver into the condenser if the subcooling temperature is less than a desired amount; and filling the receiver with refrigerant if the subcooling temperature is greater than a desired amount.

27. A method of controlling charge in a refrigeration system including a condenser and a receiver, comprising the steps of:

monitoring the subcooling temperature of the condenser;

draining refrigerant from the receiver into the condenser if the subcooling temperature is less than a desired amount; and filling the receiver with refrigerant if the subcooling temperature is greater than a desired amount.

28. The method of claim 27 including the further steps of: placing the receiver in a parallel circuiting arrangement with an expansion valve, and placing both the receiver and the expansion valve in a series circuiting arrangement with the condenser.

29. A refrigeration system comprising:

a duct;

a compressor having an inlet and an outlet;

a reheat coil located in the duct and having an outlet and an inlet operatively connected to the compressor outlet;

a condenser having an outlet, and an inlet operatively connected to the reheat coil outlet;

an expansion device having an outlet, and an inlet operatively connected to the condenser outlet;

an evaporator located in the duct upstream of the reheat coil and having an inlet operatively connected to the expansion device outlet, and having an outlet operatively connected to the compressor inlet; and a receiver system having an inlet operatively connected to the condenser outlet and having an outlet operatively connected to the evaporator inlet, the receiver system including an upstream flow control device, a receiver and a downstream flow control device arranged in series.

30. The system of claim 29 wherein refrigerant is transferred between the condenser and the receiver to control subcooling.

31. The system of claim 30 wherein the receiver system includes a controller and a sensor monitoring a condenser condition.

32. The system of claim 31 including face and bypass dampers located in the duct and operable to control airflow through and around the reheat coil.

33. The system of claim 31 wherein the expansion device is a thermal expansion device capillary tube, or electronic expansion valve, and the sensor is monitoring an evaporator condition.

34. A refrigeration system having a high pressure side and a low pressure side comprising:

an expansion device located between the high pressure side and the low pressure side;

a condenser in the high pressure side having refrigerant connections, a flooded portion and a non-flooded portion wherein the non-flooded portion exchanges heat at least an order of magnitude better than the flooded portion; and a receiver having refrigerant connections connected between the high pressure side and the low pressure side.

35. The system of claim 34 wherein the receiver refrigerant connections further include:

upstream and downstream isolation connections for the receiver wherein the upstream isolation connection is to the high side and wherein the downstream isolation connection is connected to the low pressure side.

36. A refrigeration system having a high pressure side and a low pressure side comprising:

an expansion device located between the high pressure side and the low pressure side;

a condenser in the high pressure side having refrigerant connections; and a receiver having refrigerant connections connected between the high pressure side and the low pressure side, the receiver refrigerant connections further include: upstream and downstream isolation connections for the receiver wherein the upstream isolation connection is to the high side and wherein the downstream isolation connection is connected to the low pressure side;

a condition sensor sensing a condition of an air conditioning system; and a controller, operably connected to the isolation connections and to the condition sensor, and controlling the operation of the isolation connections.

37. The system of claim 36 further including:

an evaporator and a compressor connected in series with the expansion device and the condenser, the compressor being located between the high pressure side and the low pressure side, the evaporator being located in the low pressure side.

38. The system of claim 37 further including:

a reheat coil arranged in the high pressure side between the compressor and the condenser.

39. The system of claim 38 further including face and bypass dampers associated with the reheat coil and controlling airflow therethrough.

40. The system of claim 38 wherein the isolation connections are flow control devices and the condition sensor senses condenser subcooling, and further including a sensor operably associated with the evaporator and sensing refrigerant superheat.

41. The system of claim 40 wherein the controller controls the transfer of refrigerant between the receiver and the condenser responsive to the sensed subcooling and wherein the receiver is sized to at least partially fill the condenser with refrigerant when the receiver is completely drained.

* * * * *

UNITED STATES PATENT AND TRADEMARK OFFICE

CERTIFICATE OF CORRECTION

PATENT NO : 6,122,923

DATED : September 26, 2000

INVENTOR(S): Brian T. Sullivan

It is certified that error appears in the above-identified patent and that said Letters Patent are hereby corrected as shown below:

Column 3, Line 11, "Changers™" should read --Changer™--.

Signed and Sealed this

First Day of May, 2001

*Attest:*

Nicholas P. Godici

NICHOLAS P. GODICI

*Attesting Officer*

*Acting Director of the United States Patent and Trademark Office*